US006195849B1

(12) United States Patent
Smith et al.

(10) Patent No.: US 6,195,849 B1
(45) Date of Patent: Mar. 6, 2001

(54) DIELECTRIC D-RING

(75) Inventors: Keith A. Smith, Burlington; Steve B. Levay, Font Hill, both of (CA)

(73) Assignee: Haun Drop Forge Co. Ltd. (CA)

( * ) Notice: Subject to any disclaimer, the term of this patent is extended or adjusted under 35 U.S.C. 154(b) by 0 days.

(21) Appl. No.: 09/258,276

(22) Filed: Feb. 26, 1999

(51) Int. Cl.[7] ..... A44B 11/00; E05B 49/00

(52) U.S. Cl. ..... 24/198; 24/197; 24/265 EE; 24/303; 70/278.3

(58) Field of Search ..... 24/198, 197, 265 EE, 24/303

(56) References Cited

U.S. PATENT DOCUMENTS 2,292,899 * 8/1942 Sanford ..... 24/198
4,365,391 * 12/1982 Chapalain ..... 24/197
4,520,533 * 6/1985 Kasai ..... 24/198
4,642,853 * 2/1987 Plesniarski et al. ..... 24/198
5,209,167 * 5/1993 Donner et al. ..... 105/180
5,669,118 * 9/1997 Frano et al. ..... 24/198
6,035,677 * 3/2000 Janssen et al. ..... 70/278.3

* cited by examiner

*Primary Examiner*—Victor N. Sakran
(74) *Attorney, Agent, or Firm*—Merek & Voorhees

(57) ABSTRACT

A dielectric D-ring of the type having a hook receiving opening at one end and a strap or cable receiving opening at the other. The dielectric D-ring comprises a D-ring blank encased within a dielectric injection molded plastic shell. The blank has a plurality of plastic receiving holes therethrough that receive plastic when the dielectric plastic shell is injection molded about the blank. The plastic filled holes assist in holding together the portions of the plastic shell situated on opposite sides of the blank.

14 Claims, 2 Drawing Sheets

DIELECTRIC D-RING

FIELD OF THE INVENTION

This invention relates to D-rings that have a dielectric coating and that may be used to receive the end of a strap, a hook or a piece of webbing.

BACKGROUND OF THE INVENTION

D-rings are used in a wide variety of different applications and for many different purposes in the construction industry. One common use of D-rings is for use in association with safety harnesses and belts wherein one end of the D-ring is secured to a belt or strap worn around the body of a worker. The other end of the D-ring has an opening to receive a hook attached to a safety belt or strap that is secured around a fixed object in order to prevent or limit falls while working on elevated structures.

It will be appreciated that in many instances safety harnesses, including attached D-rings, must be of a dielectric nature so that they will not conduct electricity in the event that an individual comes into contact with live electrical wires. It will also be appreciated that to be able to withstand sufficient loading, traditionally D-rings have been made from steel or a high strength metallic compound. Previously metallic D-rings have been coated with dielectric material through crude methods of dipping the rings into liquid baths of plastic or rubberized material, or by spraying a liquid dielectric material over the D-ring and allowing it to dry. In either instance the result is somewhat unsatisfactory as the thickness of the dielectric coating either cannot (or with only great effort and expense) be accurately maintained. In addition, in both instances there will always be a "hang point" where no dielectric coating is initially applied that must later be filled in. For example, when applying coatings by means of dipping, the D-ring must be grasped or held along some portion of its surface and thereafter dipped into a vat containing the dielectric material. Similarly, in order to spray a coating on the D-ring, the ring must be held along some portion of its surface, effectively creating a "hang point" In both cases the area where the ring is held does not receive any coating and must be filled in later to ensure a complete dielectric covering over the entire surface of the ring.

Hang points that have been later filled with coating material result in increased manufacturing costs and also represent a weakness in the surface of the coating material and a potential point of failure. Furthermore, in most instances the application of a liquid coating material by way of dipping can result in "runs" in the material on the surface of the D-ring, that in turn can have the effect of producing an uneven exterior surface, or causing a thinning of the coating material along certain portions of the ring. In either case, the results are undesirable. Finally, in many cases where there is not a chemical bonding of the coating material to the material from which the D-ring blank is constructed the coating is only loosely held against the ring's surface. These loosely held coatings can shift or slide during use of the ring.

SUMMARY OF THE INVENTION

The invention therefore provides a dielectric D-ring that is devoid of so called hang points and that is encased in a dielectric plastic shell that has its opposite sides physically bonded together through a plurality of holes extending through the D-ring blank.

Accordingly, in one of its aspects the invention provides a dielectric D-ring of the type having a hook receiving opening at one end and a strap or cable receiving opening at the other, the dielectric D-ring comprising a D-ring blank encased within a dielectric injection molded plastic shell, said blank having a plurality of plastic receiving holes therethrough that receive plastic when said dielectric plastic shell is injection molded about said blank to thereby assist in holding together the portions of said plastic shell situated on opposite sides of said blank.

In a further aspect the invention provides a method of producing a dielectric D-ring of a type having a hook receiving opening at one end and a strap or a cable receiving opening at the other, the method comprising the steps of forming a D-ring blank of a general size, shape, and configuration as that desired for the finished D-ring product; forming a plurality of plastic receiving holes that extend through said blank; and, thereafter, encasing the entire surface area of said blank in a dielectric plastic shell through injection molding dielectric plastic about said blank without the formation of hang points.

Further objects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

Figure 3:
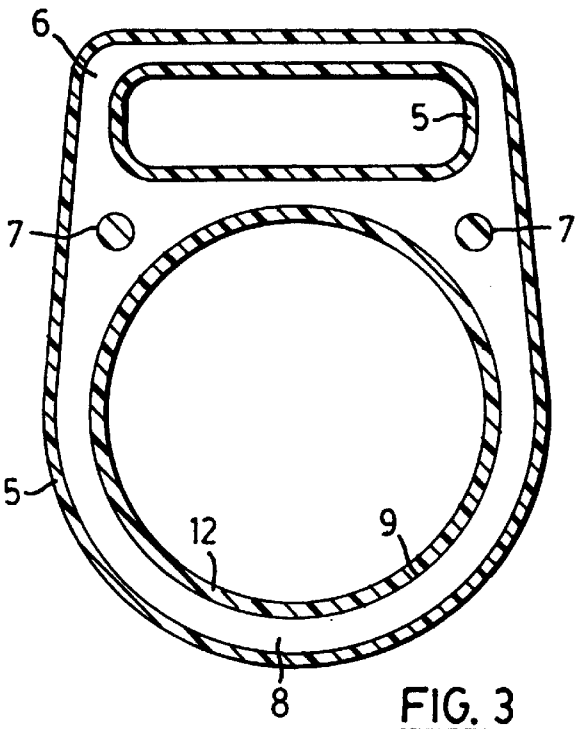
FIG. 3 is a cross-sectional view of the D-ring shown in FIG. 3 taken along the line 3—3.
Figure 2:
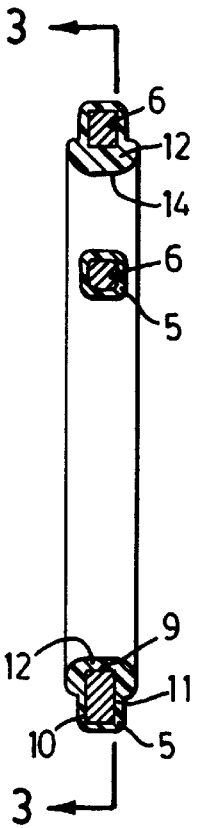
FIG. 2 is a cross-sectional view of the D-ring of FIG. 1 taken along the line 2—2.
Figure 1:
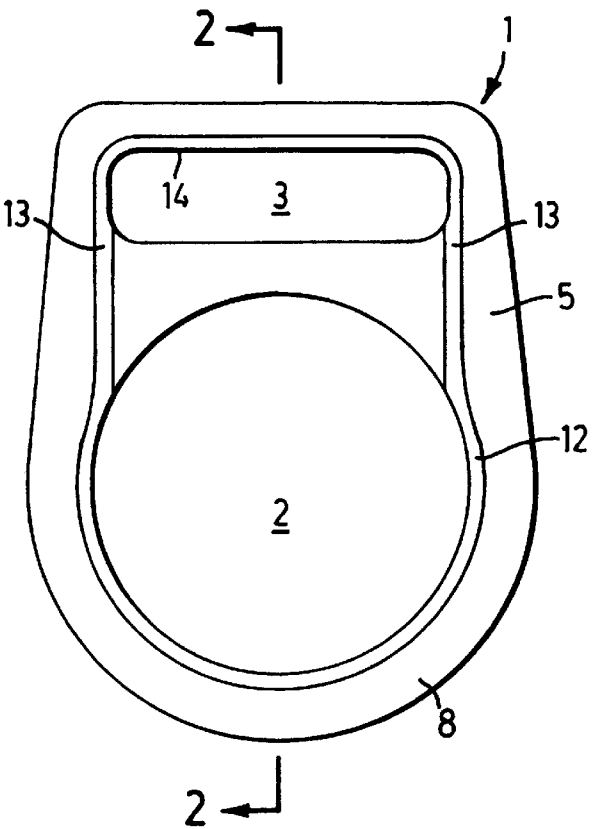
FIG. 1 is a plan view of a dielectric D-ring according to the present invention.

The present invention may be embodied in a number of different forms. However, the specification and drawings that follow describe and disclose only some of the specific forms of the invention and are not intended to limit the scope of the invention as defined in the claims that follow herein.

The dielectric D-ring of the present invention is indicated generally in the attached Figures by reference numeral 1. Dielectric D-ring 1 has the general overall shape of an elongated "D" with a hook receiving opening 2 at one end and a strap or cable receiving opening 3 at its opposite end.

Figure 4:
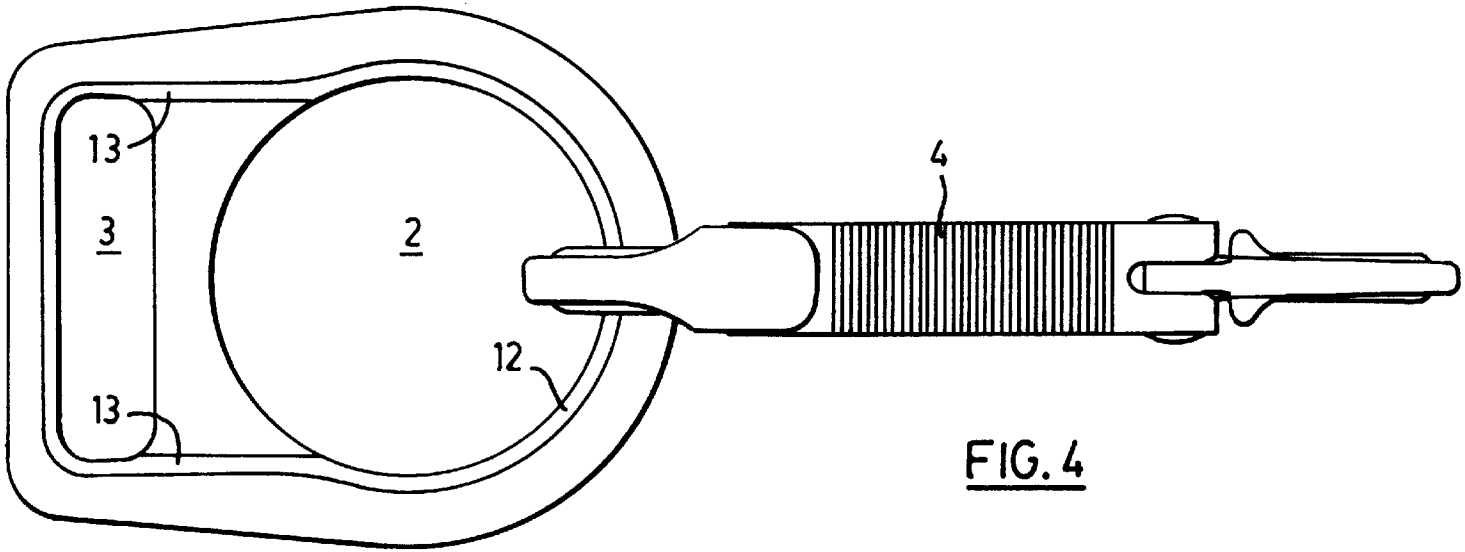
FIG. 4 is a plan view of a D-ring according to the present invention having a snap hook attached thereto; and, FIG. 5 is a side view of the D-ring in FIG. 4 having a snap hook attached thereto.
Figure 5:
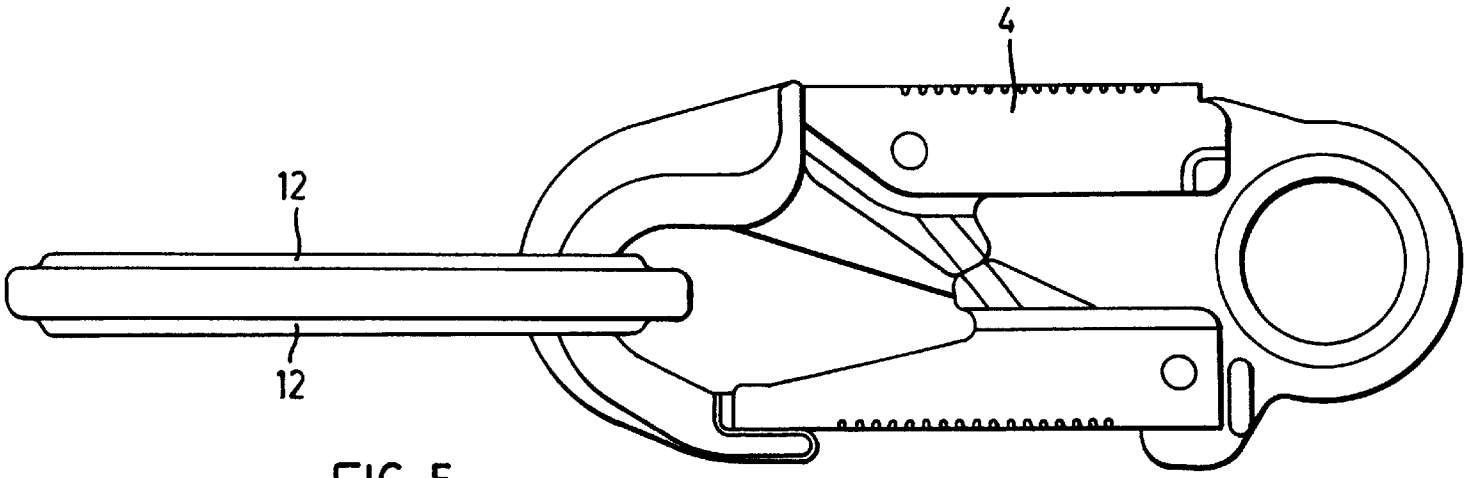

Referring to FIGS. 4 and 5, in use a snap hook 4 may be received around hook receiving opening 2 so that the hook, and a safety line, cable or belt attached thereto, may be secured to the ring. The opposite end of D-ring 1 would typically be attached to a safety belt or harness (not shown) by inserting the belt or harness through strap or cable receiving opening 3. When used as part of a safety belt or safety harness, D-ring 1 is preferably formed such that it is capable of withstanding a relatively high tensile load so as to avoid failure in instances where a worker may fall. In addition, for many applications it is important for the ring to be non-conductive so that it does not conduct electricity to a worker in the event of an accidental contact with live electrical wires.

In order for D-ring 1 to be non-conductive, in the preferred embodiment a dielectric plastic shell 5 is injection molded around a D-ring blank 6. D-ring blank 6 is relatively flat with an upper surface 10 and a lower surface 11 and is preferably formed having a general size, shape and configuration approximating that of the desired finished D-ring product. D-ring blank 6 represents the primary load bearing portion of the D-ring, and for that reason the blank is preferably made from a high strength material. D-ring blank 6 also preferably contains a plurality of plastic receiving holes 7 that are filled with plastic when the blank is encased in its dielectric plastic shell during the injection molding process. By way of plastic receiving holes 7, dielectric plastic shell 5 is held more securely about the surface of blank 6. As shown more specifically in FIG. 3, in the preferred embodiment plastic receiving holes 7 are preferably situated on opposite sides of the D-ring, and are located generally in an area of relatively large surface area. It will be appreciated that large flat areas on the surface of the blank will present potential areas of weakness in the bonding of the plastic shell about the blank. Through the formation of plastic receiving holes 7 in such areas, plastic is injection molded through holes 7 and thereby provides a positive bond between the injection molded plastic shell on either side of blank 6 by means of a solid cylinder of plastic.

To further increase the adhesion between injection molded plastic shell 5 and blank 6, the exterior surface of the blank may be roughened prior to the injection molding process. The roughening of the surface of blank 6 may be accomplished by any of a number of different known methods, including the use of abrasive materials or through chemical etching. The surface may also be roughened during the manufacturing process used to form blank 6.

As mentioned above, and as shown in FIGS. 4 and 5, the primary intended use of dielectric D-ring 1 is to receive the end of a snap hook 4. It will therefore be understood that the width of surface 8 of hook receiving opening 2 must be such that it can pass through the gateway opening of the hook and rest within the hook's bowl. In addition, since the bowls of most snap hooks are semi-circular in nature, in the preferred embodiment dielectric plastic shell 5 has an increased thickness 12 about hook receiving opening 2 and is radiused on the interior surface of the hook receiving opening to help reduce wedging of the D-ring within the bowl of the snap hook. The increased thickness of dielectric shell 5 may completely circumvent opening 2 or, alternatively, it may be located along the outward edge of opening 2 where contact with the interior surface of a hook bowl would occur. Through forming plastic shell 5 with an enlarged and radiused interior surface about hook receiving opening 2, snap hook 4 will be permitted to readily slide around the hook receiving opening as required without binding or wedging. In addition, the increased thickness 12 of dielectric plastic shell 5 about hook receiving opening 2 provides an increased wear surface in the area most subjected to wear through interaction with snap hook 4. In this manner the effective life of D-ring 1 can be significantly extended. In the preferred embodiment, the increased thickness of plastic shell 5 continues along the surface of the D-ring and also encompasses the outer edge 14 of strap receiving opening 3, thereby enhancing the wear resistance of opening 3 as well. The extension of increased thickness 12 between hook receiving opening 2 and strap receiving opening 3 results in the formation of a pair of ridges 13 on the upper and lower surface of the D-ring. Ridges 13 tend to enhance the overall tensile or puling strength of the D-ring, and increase both its application and safety factor.

The increased thickness in plastic shell 5 about hook receiving opening 2 and strap receiving opening 3 is particularly important where D-ring blank 6 is a stamped product. In the preferred embodiment blank 6 is metallic and preferably comprised of high strength steel or a similar material. The blank may be either forged or stamped. Where the blank is stamped, interior surface 9 of hook receiving opening 2 and strap receiving opening 3 will be generally flat and intersect the upper and lower surfaces 10 and 11 of the blank at approximate 90° angles. Accordingly, increasing the thickness and radiusing the portion of plastic shell 5 about interior surface 9 will effectively round off these "squared" interior surfaces and, in the case of hook receiving opening 2, reduce wedging to permit snap ring 4 to more freely move about the D-ring. The rounding off of the interior surface of strap receiving opening 3 permits the D-ring to be more smoothly slid along a strap or safety belt. Where blank 6 is forged, interior surface 9 may be rounded to some degree, however, the increased thickness and radiused nature of plastic shell 5 about inner surface 9 provides a smoother and more consistent surface than would be otherwise attainable.

Dielectric plastic shell 5 is preferably comprised of a dielectric nylon material. However, a wide variety of other similar materials may equally be used. In addition, strength or impact resistant components, including glass fibers, may be added to the plastic prior to the injection molding process. Where desired, blank 6 may be painted, coated or coloured so as to provide a visual indication means in the event that dielectric plastic shell 5 becomes worn away or is damaged, thereby exposing the underlying blank.

The present invention also includes a method of producing a dielectric D-ring of the type having a hook receiving opening at one end and a snap or cable receiving opening at the other. According to this aspect of the invention, the method comprises first forming a D-ring blank having a general size, shape and configuration the same or very similar to that as ultimately desired for the finished D-ring product. The blank is preferably metallic and manufactured by a standard stamping process from high strength steel stock, or is formed by way of forging. A plurality of plastic receiving holes that extend through the D-ring blank are either formed simultaneously with the production of the blank, or immediately thereafter by drilling through the blank body. To reduce manufacturing costs, in thc preferred embodiment the plastic receiving holes are formed simultaneously with the formation of blank body.

Once the blank, including the plastic receiving holes, has been manufactured the entire surface area of the blank is then encased in a dielectric plastic shell through injection molding. The injection molding process forms a dielectric plastic shell about the whole of the outer surface of the D-ring without the formation of traditional "hang points". In this manner there is no need to go back and later fill holes that would normally be left when a coating is applied by way of spraying or dipping. The elimination of so called "hang points" during the injection molding process is accomplished through the positioning and retaining of the blank within a mold through the use of a number of retractable pins. The retractable pins extend through the mold cavity and contact and rigidly hold the blank within the cavity. Upon injection of plastic into the cavity, the pins retract from the blank and allow the plastic to fully encase the blank. During the injection molding process the plastic receiving holes that extend through the body of the blank are filled with dielectric plastic to form a bond of plastic material through the blank that effectively joins the portions of the plastic shell situated on opposite sides of the blank's body.

The preferred method also includes the step of forming an increased and radiused thickness of dielectric plastic about all, or a portion of, the inner surface of the hook receiving opening and the strap receiving opening in the D-ring. This increased and radiused thickness of plastic enhances the receipt of a snap hook about the hook receiving opening, assists in the prevention of wedging of the hook thereon, allows the hook to readily slide around the hook receiving opening, presents increased wear surfaces for both a hook and a strap, and enhances the ability of the D-ring to be slid along and adjusted on a belt or strap. In addition, in the preferred embodiment the increased radiused thickness of dielectric plastic about the hook and strap receiving openings are joined to form a pair of ridges on both sides of the D-ring. These ridges enhance the overall pulling or tensile strength of the ring.

Finally, to further enhance the bond and adhesion between the dielectric plastic shell and the blank, in one embodiment the inventive method provides for the outer surface of the D-ring blank to be roughened prior to the injection molding process. The surface may be roughened by one of many different known techniques, including through the use of abrasive materials or etching chemicals. Alternatively, the surface may be formed with a roughened texture during the initial stamping or forging stage.

It is to be understood that what has been described are the preferred embodiments of the invention and that it may be possible to make variations to these embodiments while staying within the broad scope of the invention. Some of these variations have been discussed while others will be readily apparent to those skilled in the art.

We claim:

1. A dielectric D-ring of the type having a hook receiving opening at one end and a strap or cable receiving opening at the other, the dielectric D-ring comprising:

a D-ring blank encased within a dielectric injection molded plastic shell, said blank having a plurality of plastic receiving holes therethrough that receive plastic when said dielectric plastic shell is injection molded about said blank to thereby assist in holding together the portions of said plastic shell situated on opposite sides of said blank, said dielectric plastic shell having an increased thickness about at least a portion of said hook receiving opening, said increased thickness of said dielectric plastic shell about said hook receiving opening radiused to reduce wedging of said D-ring when received within the bowl of a hook, said increased thickness of said dielectric plastic shell increasing the wear surface area of said dielectric plastic shell about said hook receiving opening in said blank.

2. The device as claimed in claim 1 wherein said dielectric plastic shell has an increased thickness about at least a portion of said strap receiving opening, said increased thickness of said dielectric plastic shell about said strap receiving opening radiused to reduce wear on a strap or belt extending through said strap receiving opening.

3. The device as claimed in claim 1 including outwardly extending ridges formed in said dielectric plastic shell, said ridges generally aligned with the longitudinal axis of said dielectric D-ring and enhancing the tensile strength thereof.

4. The device as claimed in 3 wherein the surface of said blank is roughened to increase the surface adhesion between said dielectric plastic shell and said blank.

5. The device as claimed in claim 4 wherein said blank is metallic.

6. The device as claimed in claim 5 wherein said metallic blank is stamped from high strength steel.

7. The device as claimed in claim 6 wherein said injection molded plastic shell is comprised of dielectric nylon.

8. The device as claimed in claim 5 wherein said metallic blank is forged.

9. A method of producing a dielectric D-ring of a type having a hook receiving opening at one end and a strap or a cable receiving opening at the other, the method comprising the steps of:

(i) forming a D-ring blank of a general size, shape, and configuration as that desired for the finished D-ring product;

(ii) forming a plurality of plastic receiving holes that extend through said blank; and, thereafter, (iii) encasing the entire surface area of said blank in a dielectric plastic shell through injection molding dielectric plastic about said blank without the formation of hang points, said injection molding of said dielectric plastic about said blank including filling said plurality of plastic receiving holes with said dielectric plastic thereby forming a bond of said dielectric plastic through said blank to assist in holding together the portions of said dielectric plastic shell situated on opposite sides of said blank.

10. The method as claimed in claim 9 wherein said step of encasing said blank in said dielectric plastic shell comprises the further step of forming an increased and radiused thickness of said dielectric plastic about at least a portion of the inner surface of the hook receiving opening in said D-ring, said increased thickness of said dielectric plastic enhancing the receipt of a hook about said hook receiving opening, assisting in the prevention of wedging of a hook about said hook receiving opening, and presenting an increased wear surface on said dielectric plastic shell about said hook receiving opening.

11. The method as claimed in claim 10 wherein said step of encasing said blank in said dielectric plastic shell comprises the further step of forming outwardly extending ridges in said dielectric plastic shell, said ridges generally aligned with the longitudinal axis of said dielectric D-ring and enhancing the tensile strength thereof.

12. The method as claimed in claim 11 wherein said blank is metallic and stamped from high strength steel.

13. The method as claimed in claim 11 wherein said blank is metallic and is forged.

14. The method as claimed in claim 11 further including the step of roughening the surface of said blank prior to encasement in said dielectric plastic to increase the adhesion between said dielectric plastic shell and said blank.

* * * * *